US008562260B2

(12) United States Patent
Matys et al.

(10) Patent No.: US 8,562,260 B2
(45) Date of Patent: Oct. 22, 2013

(54) WET CAST CONCRETE SEGMENTAL RETAINING WALL BLOCK

(76) Inventors: Tyler Matys, Newmarket (CA); Angelo Risi, Maple (CA)

( * ) Notice: Subject to any disclaimer, the term of this patent is extended or adjusted under 35 U.S.C. 154(b) by 0 days.

(21) Appl. No.: 13/364,868

(22) Filed: Feb. 2, 2012

(65) Prior Publication Data

US 2012/0195696 A1 Aug. 2, 2012

(30) Foreign Application Priority Data

Feb. 2, 2011 (CA) ..... 2730187

(51) Int. Cl.
*E02D 29/02* (2006.01)

(52) U.S. Cl.
USPC ..... 405/286; 52/604; 52/608

(58) Field of Classification Search
USPC ..... 405/262, 284, 286; 52/604, 606, 608
See application file for complete search history.

(56) References Cited

U.S. PATENT DOCUMENTS

| | | | | |
|---|---|---|---|---|
| 604,658 | A * | 5/1898 | Forster | 52/606 |
| 1,382,652 | A * | 6/1921 | Kiefer | 52/204.1 |
| 3,635,459 | A | 1/1972 | Mare | |
| 6,591,569 | B2 | 7/2003 | Azar | |
| 6,821,058 | B1 | 11/2004 | Dawson | |
| 6,907,704 | B2 * | 6/2005 | Abang et al. | 52/605 |
| 7,168,892 | B1 | 1/2007 | Macdonald et al. | |
| 7,384,215 | B2 | 6/2008 | Woolford | |
| 7,591,447 | B2 | 9/2009 | Hammer et al. | |
| 2008/0289282 | A1 | 11/2008 | MacDonald | |

FOREIGN PATENT DOCUMENTS

| | | | |
|---|---|---|---|
| DE | 3837243 | A1 * | 5/1989 |
| WO | WO-2006053377 | | 5/2006 |

OTHER PUBLICATIONS

Company Name: CEMEX; FrogStone, May 1, 2007, 1 page; http://www.cemexusa.com/bp/bp_ap_sr.html.

* cited by examiner

*Primary Examiner* — Sunil Singh
(74) *Attorney, Agent, or Firm* — Pauly, DeVries Smith & Deffner, L.L.C.

(57) ABSTRACT

A concrete block and a concrete block set for building a segmental retaining wall. Each block of the block set comprises front and back faces connected together by side walls extending between a top surface and a bottom surface. The shapes of the side walls create a lateral interlock system between adjacent blocks, and one of the side walls is preferably inwardly bevelled. Each block of the block set also comprises a longitudinal slot on the bottom surface. The blocks forming a first subset of the block set are provided with a vertical connector centered between said front and back faces, on the top surface, and sized to fit into the longitudinal slot located on the bottom surface of a block positioned immediately above in a segmental retaining wall. The blocks forming a second subset are not provided with such a vertical connector.

8 Claims, 7 Drawing Sheets

WET CAST CONCRETE SEGMENTAL RETAINING WALL BLOCK

This application claims the benefit of Canadian Patent Application No. CA 2,730,187, entitled "WET CAST CONCRETE SEGMENTAL RETAINING WALL BLOCK", filed Feb. 2, 2011, which application is hereby incorporated by reference in its entirety.

FIELD OF THE INVENTION

The present invention relates to retaining wall blocks. More particularly, it relates to wet cast segmental retaining wall blocks allowing the users to construct a randomly stacked retaining wall without the need for pins or clips for shear resistance or the need to follow intricate laying patterns.

BACKGROUND OF THE INVENTION

When it comes to landscape design and architecture, natural, real rock retaining walls are often considered the pinnacle of classic, timeless design and aesthetics. These types of walls, often constructed from natural flagstones, boulders or quarry stones, have been dry stacked or mortared together for many years, but require considerable skills to be of a steady durable construction. Moreover, natural stone walls are expensive to build, as natural stones are costly and the process of fitting the random stone pieces into a tight, coherent mass is time consuming and require an experienced craftsman.

Due to the popularity of the natural stone look, attempts have been made to reproduce it with manufactured retaining wall product. Two processes are currently known in the manufacture of such blocks: dry-cast blocks and wet-cast blocks. Dry-cast blocks are made using a combination of a concrete mix with very low water content, and a steel mold where large compression/vibration forces are used to compact the dry concrete mixture. On the other hand, wet-cast blocks are generally made by pouring concrete into a stiff or flexible mold that is open on top, and then leaving the concrete inside the mold for a curing period. However regardless of the method used to manufacture these blocks a true random stacking appearance has not been achievable. This is partly due to the following reasons:

1) Interlock system: Segmental retaining walls require some type of vertical interlock or shear resistance between the courses. Therefore, predetermined laying patters are required in order for the male interlock (pin, knob or lug) of the lower course to find the corresponding female core or slot in the upper course. As such, random stacking patterns are often not possible.
2) Block Size: Due to above-described reasons, the size (face width) of the blocks made according to the existing solutions, are limited to 2-3 different dimensions. Even with this limited number of face widths, specific laying patterns are required in order for the blocks to fit together and not result in a conflict between the vertical interlock of the block in the lower course and the core of the block in the upper course.

Most dry-cast segmental retaining wall blocks have some type of vertical shear connection system to align the blocks in the wall, and prevent lateral earth forces from dislodging individual courses from the wall. Common types of connection include the tongue and groove system, the lug and core system, and the inclusion of multiple cores or grooves which require the installer to use an additional pin or clip to connect the blocks.

The above-mentioned types of connection are possible for retaining wall blocks manufactured using the dry-cast process as it allows the casting of shapes into both the bottom and the top surfaces of the block. As such, matching positive and negative shapes, or matching cores or grooves, can be cast into the top and bottom of the blocks to achieve an integral vertical interlock between the blocks located in the different courses.

However, the downside of the dry-cast process is that the textures created are very limited since the process involves the use of a steel mold which "eject" the product vertically after the vibration and compression cycle. Thus, the vertical faces of the resulting block cannot have any texture that is not in line with the vertical direction in which the product is "ejected". Even when a dry-cast facing panel is realised and textured with a specialized press head, the look is still limited to the patterns or shapes created by a small number of the dry-cast press heads. Moreover, the depth of the false joints (which are typical to the look of a natural stone wall) is limited to the depth that the press head can reasonably reach by compression force.

Therefore, in order to achieve a true simulated rock texture, the blocks need to be manufactured using a wet-cast process as only more flexible molds can recreate the intricate detailing and texture of natural materials such as rocks.

However, the process of wet casting a concrete block, by its nature, has certain limitations. As previously explained, wet casting implies that concrete is poured into a mold that is open on top. Consequently, simulated texture can be cast on the sides and bottom of the blocks, but the top surface of the mold (which corresponds to the bottom surface of the corresponding manufactured block) remains open, and therefore cannot be textured or shaped as it is not contained. This poses a problem when it comes to the creation of an integral vertical connection system between wet-cast segmental retaining wall blocks. Since no shape can be cast into the bottom surface, current wet-cast blocks either do not have a connector system (and require the craftsman to secure them with adhesive) or have a rear lip system, this system requiring that only one surface be cast.

The drawback associated with walls constructed using blocks having a rear lip as vertical interlock system is that, when stacked, these blocks end up setting back each successive course of a distance equal to the thickness of the rear lip. This built-in set back is not always desirable, as vertically aligned walls (which require a vertically aligned connector system) are preferable for smaller landscape type walls, for example.

Hence, in light of the aforementioned, there is a need for an improved wet-cast concrete segmental retaining wall block which, by virtue of its design and components, would be able to overcome or at least minimize some of the above-discussed prior art concerns.

SUMMARY OF THE INVENTION

The present invention concerns a concrete block and a set of concrete blocks offering a dual interlock system (horizontal and lateral interlocks) which allows the creation of natural looking retaining wall offering good shear resistance. The natural look is possible because of the truly random laying pattern that can be achieved with the concrete blocks of the present invention without the use of pins or clips.

In accordance with one aspect of the invention, there is provided a concrete block for building a segmental retaining wall. The concrete block comprises front and back faces connected together by side walls located on opposite sides of the block and extending between a top surface and a bottom surface, wherein the side walls have a shape that create a lateral interlock system between adjacent blocks of the segmental retaining wall. The concrete block also comprise a longitudinal hollow core forming a longitudinal slot on the bottom surface, the longitudinal slot being centered between the front and back faces, and extending over a portion of a distance extending between the side walls, the portion covering a majority of the distance. The concrete block finally comprise a vertical connector located on the top surface of the block and centered between the front and back faces, the vertical connector being sized to fit into the longitudinal slot located on the bottom surface of a block positioned immediately above in the segmental retaining wall.

Preferably, the above-mentioned shape of each of the side walls, which creates the lateral interlock system, is a S-shape. Thus both side walls of the block according to this aspect of the invention are preferably S-shaped.

Preferably, the above mentioned S-Shape of the first of the side walls of the block is a neutral S-shape while the S-shape of the second of the side walls of the block is a positive S-shape resulting in an inward bevel of the second side wall.

Preferably, the longitudinal walls located on both sides of the hollow core have a parabolic shape, the curve of these walls becoming steeper as it approaches the bottom surface of the block (which corresponds with the top surface of the mold). Consequently, the opening of the hollow core is wider on the top surface of the block than on its bottom surface. This particular shape of the hollow core eases the demolding of the manufactured blocks, as will be explained below.

Still preferably, the textures of the front and back faces of the block are different in order to offer more different apparent textures when constructing a retaining wall.

According to another aspect of the present invention, there is provided a concrete block set for building a segmental retaining wall. The concrete block set includes a first subset of concrete blocks and a second subset of concrete blocks. The blocks included in the first subset comprise front and back faces connected together by side walls located on opposite sides of the blocks and extending between a top surface and a bottom surface, wherein the side walls have a shape that create a lateral interlock system between adjacent blocks of the segmental retaining wall. The blocks included in the first subset further comprise a longitudinal hollow core forming a longitudinal slot on the bottom surface, the longitudinal slot being centered between the front and back faces, and extending over a portion of a distance extending between the side walls, the portion covering a majority of the distance. The blocks included in the first subset finally comprise a vertical connector located on the top surface of the block and centered between the front and back faces, the vertical connector being sized to fit into the longitudinal slot located on the bottom surface of a block positioned immediately above in the segmental retaining wall. The blocks included in the second subset comprise front and back faces connected together by side walls located on opposite sides of the blocks and extending between a top surface and a bottom surface, wherein the side walls have a shape that create a lateral interlock system between adjacent blocks of the segmental retaining wall. The blocks included in the second subset also comprise a longitudinal hollow core forming a longitudinal slot on the bottom surface, the longitudinal slot being centered between the front and back faces, and extending over a portion of a distance extending between the side walls, the portion covering a majority of the distance. Finally, the blocks included in the second subset have a smooth top surface free of vertical connector.

Once again, preferably, the above-mentioned shape of each of the side walls of the blocks of the first and second subset, which creates the lateral interlock system, is a S-shape. Thus both side walls of the blocks of the first and second subset, according to this aspect of the invention, are preferably S-shaped.

Preferably, the above mentioned S-Shape of the first of the side walls of the blocks of the first and second subset is a neutral S-shape, while the S-shape of the second of the side walls of the blocks of the first and second subset is a positive S-shape resulting in an inward bevel of the second side wall.

Preferably, the longitudinal walls located on both sides of the hollow core of the blocks of the first and second subset have a parabolic shape, the curve of these walls becoming steeper as it approaches the bottom surface of the blocks (which corresponds with the top surface of the mold). Consequently, the opening of the hollow core is wider on the top surface of the blocks than on their bottom surface. This particular shape of the hollow core eases the demolding of the manufactured blocks, as will be explained below.

Still preferably, the concrete blocks of the first and second subsets comprise blocks of different lengths. The textures of the front and back faces are also preferably different.

According to another preferred aspect of the present invention, there is provided a method of building a segmental retaining wall using the concrete block set described hereinabove.

BRIEF DESCRIPTION OF THE DRAWINGS

For a better understanding of the invention and to show how the same may be carried into effect, reference is now made by way of example to the accompanying drawings in which.

DETAILED DESCRIPTION OF THE INVENTION

Figure 1:
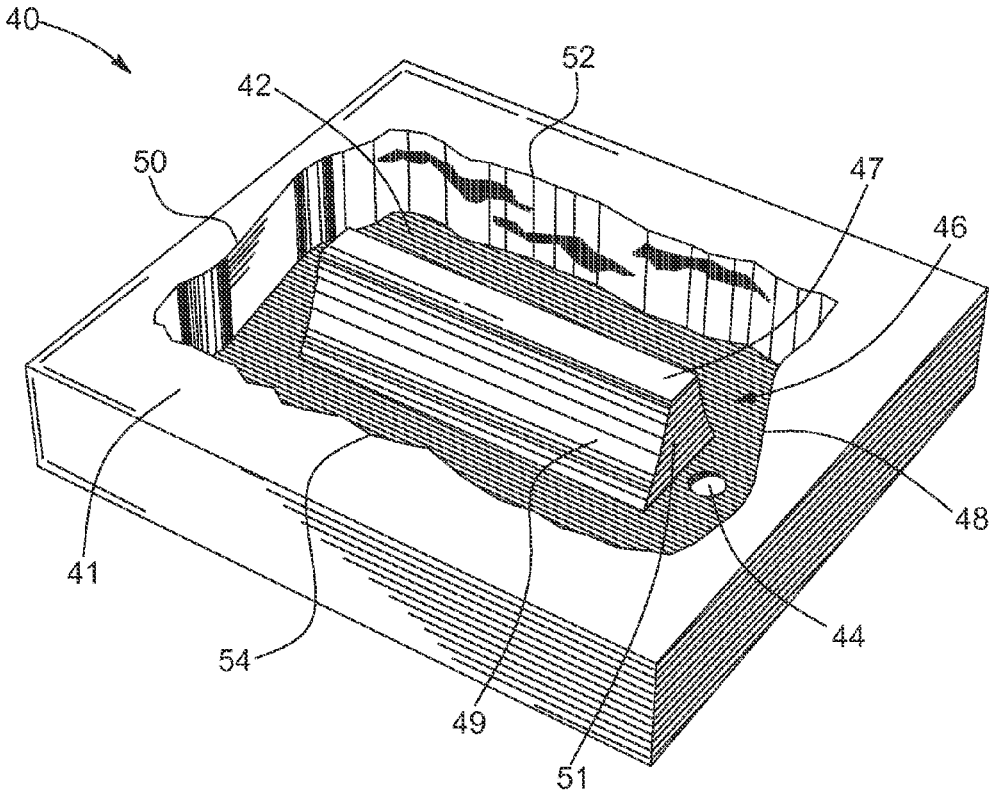
FIG. 1 is a perspective view of a mold used to manufacture a concrete block according to an embodiment of the present invention.

In accordance with one aspect of the present invention, there is provided a concrete block offering a combination of vertical and lateral interlocks, when used in the construction of a retaining wall, designed to achieve a truly random stacking capability while maintaining the vertical stability of the resulting wall without resorting to pins or clips.

Referring to FIGS. 4 to 11, a concrete block 10 and a block set 30 according to embodiments of the present invention are shown. The block set 30 comprises many different models of blocks 10, each having a predetermined length and face texture. Each block 10 comprises a front face 12, a back face 14, side walls 16, 18 located on opposite sides, a top surface 20 and a bottom surface 22. The front face 12 and back face 14 are textured in order to recreate a rock relief (or the relief of other natural materials). The front 12 and back 14 faces of a block 10 preferably display a different texture to allow a maximum of different textures in the resulting walls (as both the front 12 and back 14 faces can be used in the apparent face of a wall). The height of the blocks of the different models, may also vary. When there are blocks 10 of different height in a set 30, blocks of similar height are evidently used for a given course in the construction of a wall.

As can be seen in FIGS. 4 to 8, where a concrete block 10 is shown, the side walls 16, 18 of the block 10 are shaped in such a way as to produce a lateral interlock system between the adjacent blocks of a retaining wall. Preferably, the shape of each of these side walls 16, 18 is a S-shape, such as the one described in European community design Application No. 87168. However, one skilled in the art will easily understand that other shapes could also provide the desired lateral interlock system. It should also be understood that the preferred shape of the side walls 16, 18 is described as a S-shape in order to express that it follows and outward curve followed by an inward curve, but that these curves need not be smooth or regular.

Figure 4:
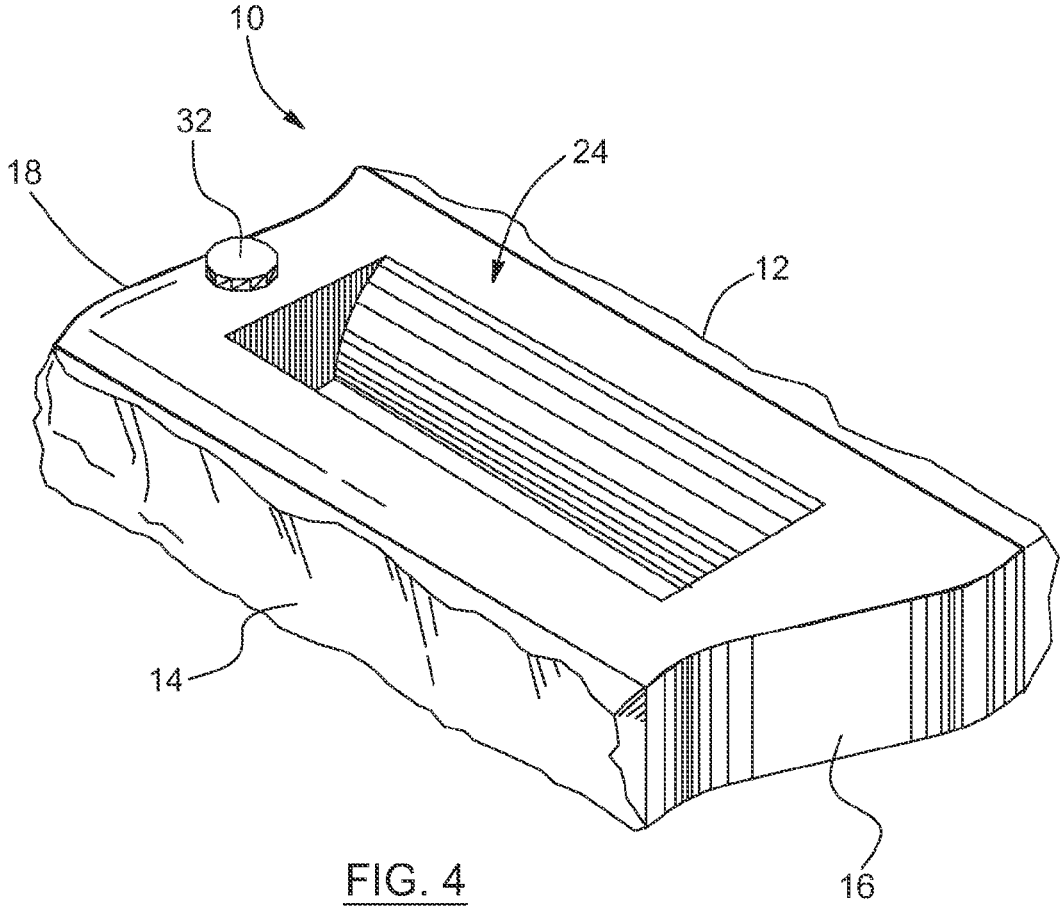
FIG. 4 is a perspective view of a concrete block according to an embodiment of the present invention.
Figure 5:
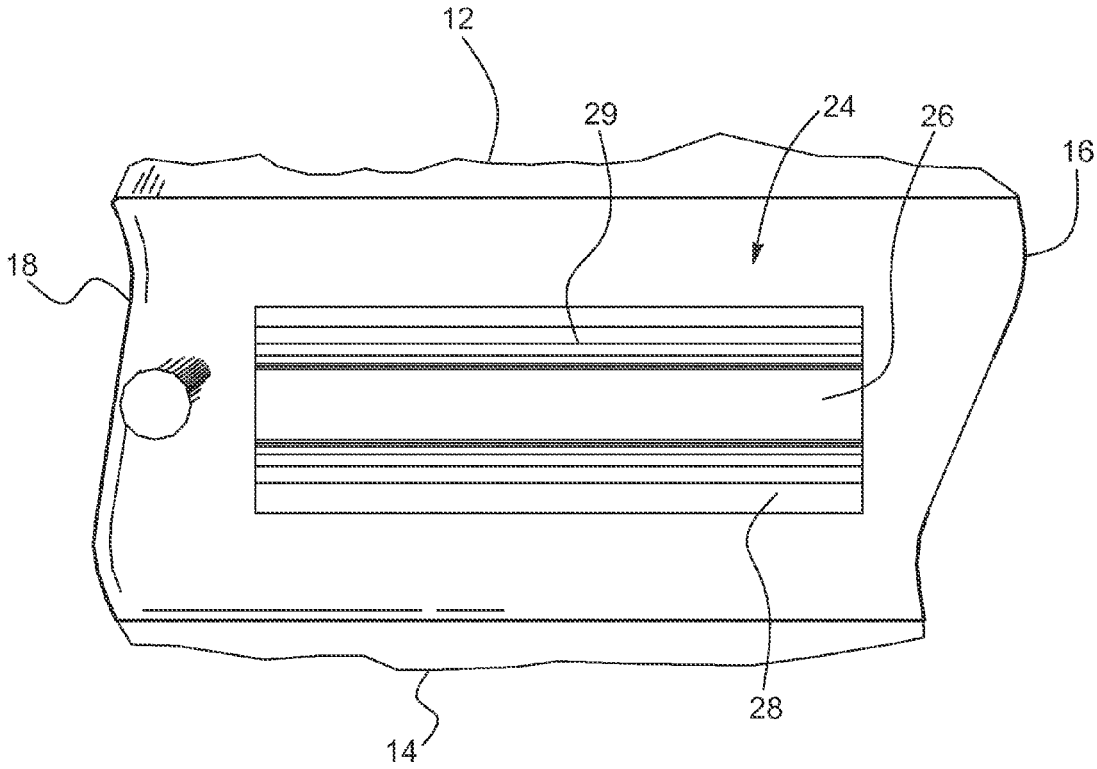
FIG. 5 is a plan view of the concrete block of FIG. 4.
Figure 6:
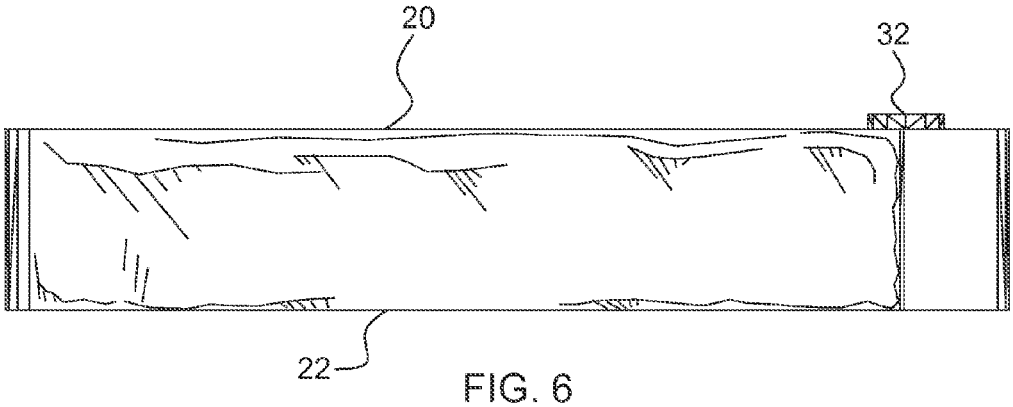
FIG. 6 is a front elevation view of the concrete block of FIG. 4.
Figure 7:
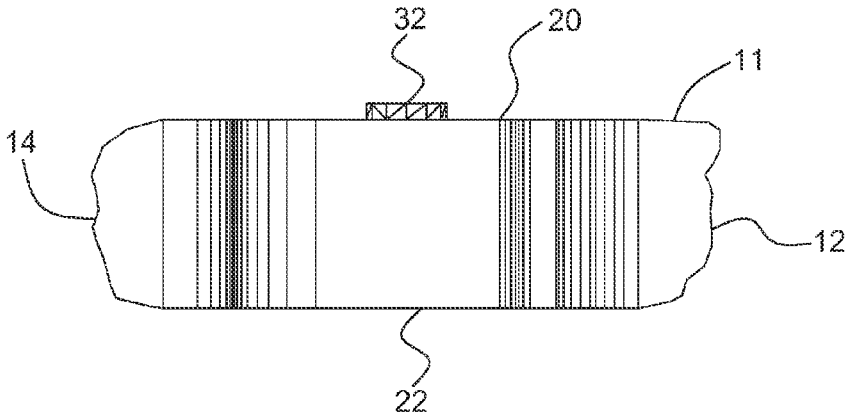
FIG. 7 is a side elevation view of the concrete block of FIG. 4.

Now referring to FIGS. 4 and 5, in a preferred embodiment the lateral S-shape of one of the side wall 16 is such that this side wall 16 is inwardly bevelled as a result of the positive bulging of the S-shape. The lateral S-shape of the other side wall 18 is neutral, the inward curve being equivalent to the outward curve. This feature allows the creation of curved walls (as shown in FIG. 8) or straight walls (as shown in FIG. 9) using the block set 30 according to this preferred embodiment of the invention.

Figure 8:
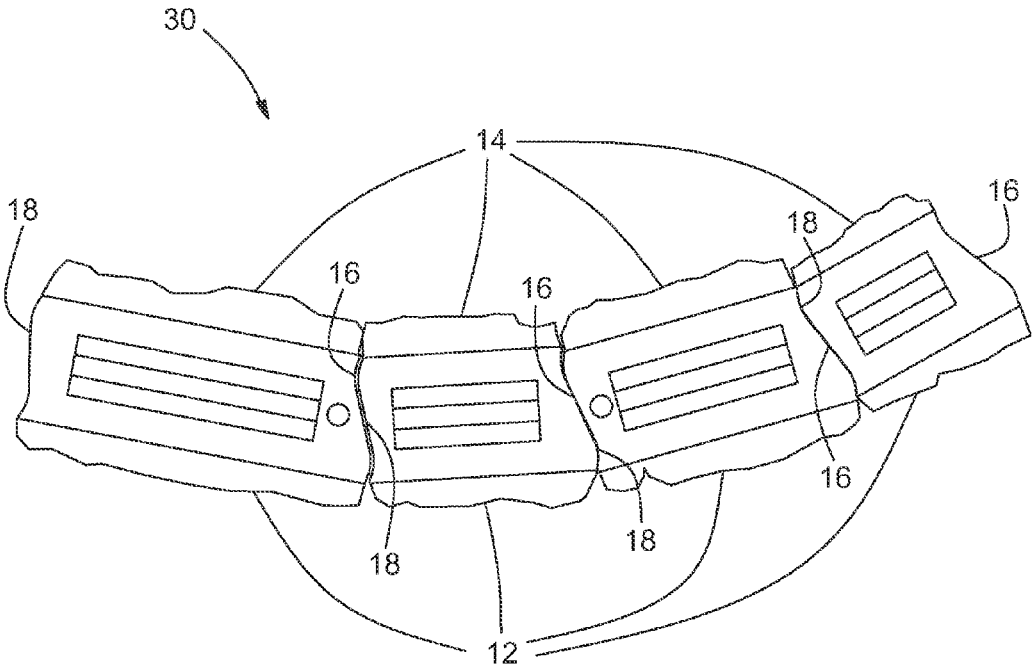
FIG. 8 is a plan view of a course of four concrete blocks of a block set according to an embodiment of the present invention, shown in a curved alignment configuration.

Thus, when a horizontally curved wall as the one shown in FIG. 8 is desired, a worker will arrange the blocks 10 all according to the same direction. Therefore, the bevelled side wall 16 of a block will connect with the neutral side wall 18 of the adjacent block 10. This process will be repeated over the distance where a curve is desired.

Figure 9:
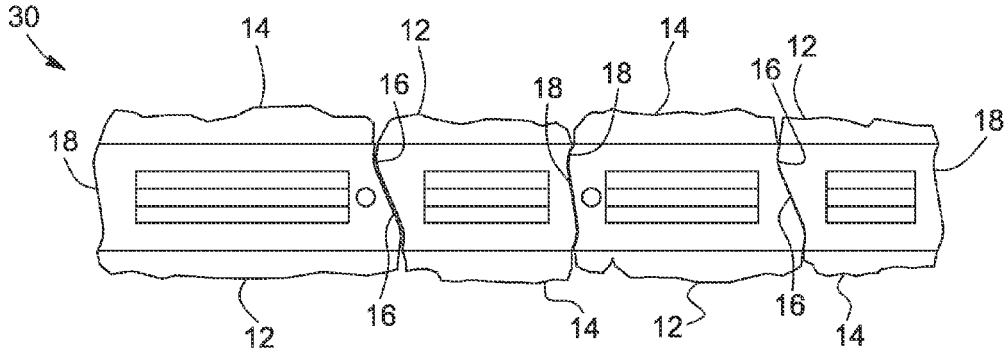
FIG. 9 is a plan view of a course of four concrete blocks of a block set according to an embodiment of the present invention, shown in a straight alignment configuration.

However, when a worker wants to build a horizontally straight wall as the one shown in FIG. 9, adjacent blocks 10 will be arranged according to opposite directions, each successive block being rotated horizontally of 180 degrees, resulting in the alternation of the front face 12 and back face 14 of successive block in the apparent face of the resulting wall. This arrangement will result in the bevelled side wall 16 of a block 10 connecting with the bevelled side wall 16 of the adjacent block 10 (the opposite directions of the bevels cancelling their effect), and the neutral side walls 18 of adjacent blocks connecting together. Once again this arrangement will be carried on over the distance on which a straight wall is desired.

Now referring to FIGS. 4 and 5, the blocks 10 according to a preferred embodiment of the present invention also comprise a longitudinal hollow core 24 forming a longitudinal slot 26 on the bottom surface 22. The longitudinal slot 26 is centered between the front 12 and back 14 faces of the block 10, in order to allow the construction of vertically aligned walls when used as part of the vertical interlock system that will be described hereinunder. The longitudinal hollow core 24 and corresponding longitudinal slot 26 extend over a portion of the distance between the side walls 16, 18. This portion of the distance covers the majority of the distance between these side walls. A section without hollow core 24 is provided towards the ends of each block 10 in order to maintain the structural stability of the block 10.

In a preferred embodiment, the hollow core 24 is larger at the top surface 20 of the block 10 and tappers towards the bottom surface 22. Moreover, according to this preferred embodiment, the longitudinal walls 28, 29 of the longitudinal hollow core 24 follow a parabolic curve, the curve becoming steeper towards the bottom surface 22.

Moreover, as can be seen in FIGS. 4 to 7, a subset of the blocks 10 forming the set of blocks 30 also comprises a vertical connector 32. This vertical connector 32 is centered between the front 12 and back 14 faces of the block 10, and is positioned between one end of the hollow core 24 and the corresponding side wall 16 or 18.

Figure 10:
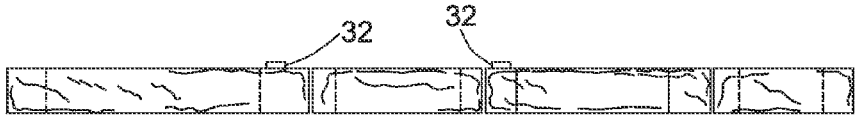
FIG. 10 is a front elevation view of the course of four concrete blocks of FIG. 9.
Figure 11:
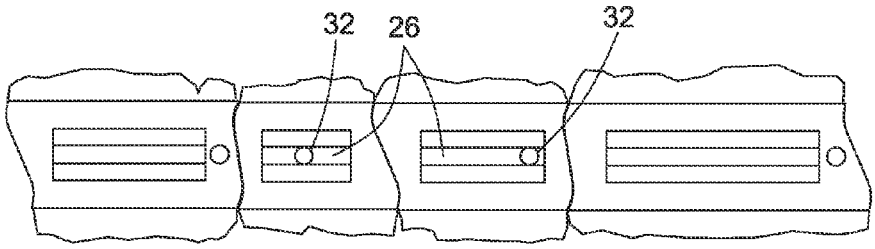
FIG. 11 is a plan view of a course of four concrete blocks of a block set according to an embodiment of the present invention, shown in a straight alignment configuration and stacked over the course of four concrete blocks of FIG. 9.

As exemplified by FIGS. 9 to 11, the vertical connector 32 preferably has the shape of a knob with a round edge, but, as will be apparent to one skilled in the art, the vertical connector 32 could be embodied using a different shape without departing from the scope of the present invention. The size of the vertical connector 32 is such that when another block 10 of the set of blocks 30 according to the present invention is stacked over a block 10 having a vertical connector 32, the vertical connector 32 fits into the longitudinal slot 26 of the block stacked above. An example of such a vertical connection between a block 10 in a lower course and that of an upper course is shown in FIGS. 10 and 11, where the vertical connectors 32 of the blocks of the lower course are fitted into the longitudinal slot 26 cast on the bottom surface in the blocks of the upper course.

As can be seen in FIGS. 8 to 12, the set of blocks 30 according to the present invention also includes another subset of blocks 10 whose upper surface is free of vertical connector. The blocks of the present subset are similar to those of FIGS. 4 to 7, to the exception that their top surface 20 is flat where the top surface 20 of those presented in FIGS. 4 to 7 is provided with the vertical connector 32.

Therefore, when building a retaining wall, a worker will alternate between blocks comprising a vertical connector 32 and those that do not, in the placement of adjacent blocks. The alternation need not be regular, which means that a block comprising a vertical connector 32 will not necessarily be followed by a block free of vertical connector and vice-versa, as long as there is an alternation between the blocks of both subsets and that the maximum horizontal distance between the vertical connectors 32 in a course is respected. This maximum horizontal distance has been measured to be in the range of two feet. The alternation between blocks comprising a vertical connector 32 and those free of vertical connector reduces the overall amount of vertical connectors 32 in each course of a resulting wall, and therefore greatly reduces the risks that a vertical connector 32 of a block in a lower course coincides with a section of a block of an upper course where no slot 26 is provided, even when blocks 10 of many different widths are stacked according to a random laying pattern.

The natural consequence of the above-described intermittent vertical interlock is that the vertical stability of the resulting wall is diminished because certain blocks are not vertically interlocked. However, the lateral interlock system of the blocks 10 forming the set of blocks 30 of the present invention compensates for the intermittent lack of vertical connector by connecting all of the adjacent blocks 10 laterally. Thus, the shear resistance of the blocks 10 with the vertical connector 32 is shared with the adjacent blocks. There results a dual interlock system (laterally and vertically) which allows the arrangement of blocks 10 of many different widths according to a random laying pattern, without the risk of interference between vertical connectors 32 and a section of blocks in an upper course without a receiving slot (which is not the case when a vertical connector is present on every block), while still offering the same shear resistance as a wall in which a vertical connector is present on every block.

Now referring to FIGS. 1 to 3, blocks 10 such as those described hereinabove for forming the set of blocks 30, according to the present invention, are manufactured using a mold 40 such as the one shown in those Figures, or a gang mold comprising a plurality of such mold. The bottom 42 of the mold 40 corresponds with the top surface 20 of the manufactured block 10. The upper open section corresponds with the bottom surface 22 of the block 10. Preferably the mold is made of a polyurethane composite, but as will be apparent to one skilled in the art, other material (such as rubber) could be used without departing from the present invention.

Figure 2:
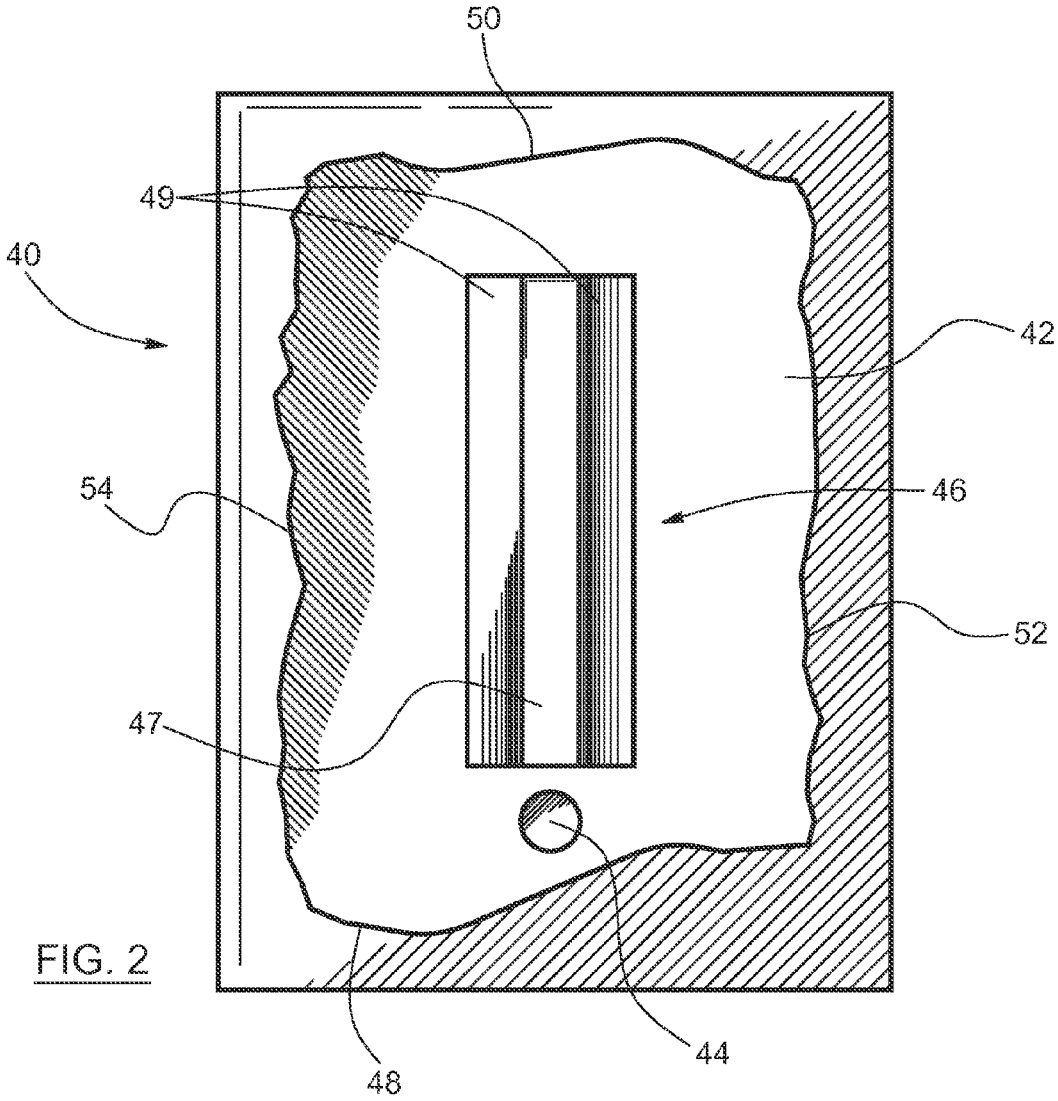
FIG. 2 is a plan view of the mold of FIG. 1.
Figure 3:
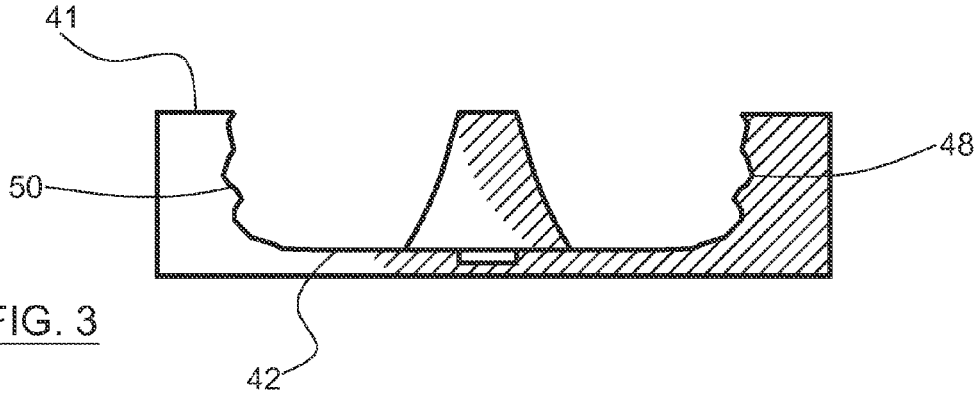
FIG. 3 is a cross sectional view of the mold of FIG. 1.

The mold presented in FIGS. 1 to 3 presents a hollow section 44 on the bottom surface 42 for the molding of the vertical connector 32 which is provided on the blocks 10 of the first subset. As will be easily apparent to one skilled in the art, a mold 40 used to manufacture a block without vertical connector would be free of such hollow section 44, and would present a completely flat bottom surface 42. The shape of the inner side walls 48, 50 is such that the preferable S-shape will preferably be cast onto the side walls 16, 18 of the manufactured block 10. The same can be said for the front 52 and back 54 walls, which are textured with different patterns for the molds of each block model of the set of blocks 30 (the front 52 and back 54 walls of a particular mold preferably also have a different texture), so that the resulting textures (on the front 12 and back 14 faces of the manufactured block) are different on each block models.

Moreover, the mold 40 is provided with a tower structure 46 located at a center position between the front 53 and back 54 walls of the mold 40. The tower structure 46 has the inverse shape of the hollow core 24 of the block 10. Hence, the tower structure 46 is larger at the base and tapers towards the top. The tower structure 46 is at least as high as the height of the mold, the top surface of the tower structure 47 preferably being flat and evenly levelled with the top surface of the mold 41. The top surface 46 (or the tower structure at the intersection of a vertical plane corresponding with the top surface of the mold 41) has a predetermined width, which corresponds to the desired width of the longitudinal slot 26 of the resulting block 10.

Preferably the longitudinal side walls 49 of the tower structure 46 are parabolically shaped, such that the longitudinal walls of the hollow core 24 of the block 10 manufactured using the mold 40 have the preferable parabolic shape. The parabolic shape of the longitudinal walls 49 of the tower structure 46 facilitates the demolding of the cured concrete block 10. Indeed, the demolding of a cured concrete block is preferably achieved by the folding of the mold from one side or end (or by the pulling of the concrete block 10 at one side or end) and subsequent peeling of the mold 40 toward the opposite side or end (as opposed to a vertical pullout). During this peeling process, the tower structure 46 would normally tend to create an obstacle that adds complexity to the peeling process. However, the parabolic shape of the longitudinal walls 49 of the tower structure 46, minimizes the obstruction of the tower structure 46 in the peeling process, by providing a smooth transition between the bottom surface 42 and the tower structure 46, allowing the peeling process to be carried out almost as easily as for a block without a tower structure 46. In the Figures presented herewith, the end walls 51 of the tower structure 46 are shown as flat walls. However, as will be easily understood by one skilled in the art, these end walls 51 could also have a parabolic shape, or any other shape which could facilitate the demolding of the cured block, without departing from the scope of the present invention.

In order to further facilitate the demolding of the cured concrete block, as exemplified in FIG. 3, the texture of the front 48 and back 50 walls of the mold 40 preferably creates a widening towards the top surface 41 of the mold 40. Moreover, the texture is preferably free of crevices, shelves, or the like, which could restrain the cured concrete from being demolded.

It will be readily understood by one skilled in the art that the above-mentioned embodiments are merely illustrative of the possible specific embodiments which may represent principles of the present invention. Of course, numerous modifications could be made to the embodiments described above without departing from the scope of the present invention as defined in the appended claims.

The invention claimed is:

1. A concrete block for building a randomly stacked segmental retaining wall, said concrete block comprising:

a front face and a back face connected together by first and second S-shaped side walls located on opposite sides of said block and extending between a top surface and a bottom surface, wherein the shape of said first side wall is a neutral S-shape and the shape of the said second side wall is a positive S-shape resulting in an inward bevel of said second side wall, and wherein said side walls are configured to create a lateral interlock system between the block and one or more adjacent blocks in said segmental retaining wall;

said bottom surface defining a longitudinal slot, said longitudinal slot being centered between said front and back faces, and extending over a portion of a distance extending between said side walls, said portion covering a majority of said distance; and a vertical connector located on said top surface of said block and centered between said front and back faces, said vertical connector being configured to fit into an adjoining longitudinal slot to form an intermittent vertical interlock, said adjoining longitudinal slot defined by a bottom surface of an adjoining block positioned immediately above said concrete block in said segmental retaining wall.

2. The concrete block according to claim 1, wherein said longitudinal slot is defined by parabolically shaped longitudinal walls.

3. The concrete block according to any one of claim 1, wherein said concrete block has different textures on said front and back faces.

4. A concrete block set for building a randomly stacked segmental retaining wall, said concrete block set including a first subset of concrete blocks and a second subset of concrete blocks, wherein each of the blocks included in the first subset comprises:

a front face and a back face connected together by first and second S-shaped side walls located on opposite sides of said block and extending between a top surface and a bottom surface, wherein the shape of said first side wall is a neutral S-shape and the shape of the said second side wall is a positive S-shape resulting in an inward bevel of said second side wall, and wherein said side walls are configured to create a lateral interlock system between the block and one or more adjacent blocks in said segmental retaining wall;

said bottom surface defining a longitudinal slot, said longitudinal slot being centered between said front and back faces, and extending over a portion of a distance extending between said side walls, said portion covering a majority of said distance; and a vertical connector located on said top surface of said block and centered between said front and back faces, said vertical connector being configured to fit into an adjoining longitudinal slot to form an intermittent vertical interlock, said adjoining longitudinal slot defined by a bottom surface of an adjoining block positioned immediately above said concrete block in said segmental retaining wall;

and wherein each of the blocks included in the second subset comprises:

a front face and a back face connected together by first and second side walls located on opposite sides of said block and extending between a top surface and a bottom surface, wherein said side walls have shapes configured to create a lateral interlock system between the block and one or more adjacent blocks in said segmental retaining wall;

said bottom surface defining a longitudinal slot, said longitudinal slot being centered between said front and back faces, and extending over a portion of a distance extending between said side walls, said portion covering a majority of said distance; and a top surface free of vertical connector.

5. The concrete block set according to claim 4, wherein said longitudinal slot of each of said blocks of the first and second subsets is defined by parabolically shaped longitudinal walls.

6. The concrete block set according to claim 4, wherein each of said first and second subsets of concrete blocks comprise blocks having different lengths and different textures on said front and back faces.

7. A method of building a segmental retaining wall using the concrete block set according to claim 4, wherein successive block courses are created using blocks of said first subset and blocks of said second subset.

8. The method of building a segmental retaining wall of claim 7 wherein the maximum horizontal distance between each vertical connector of a block course is about two feet.

* * * * *